US009608380B2

(12) United States Patent
Horning et al.

(10) Patent No.: US 9,608,380 B2
(45) Date of Patent: Mar. 28, 2017

(54) ELECTRICAL CONNECTOR HAVING A GROUND SHIELD

(71) Applicant: Tyco Electronics Corporation, Berwyn, PA (US)

(72) Inventors: Michael James Horning, Lancaster, PA (US); Wayne Samuel Davis, Harrisburg, PA (US); Xingling Zhou, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/728,269

(22) Filed: Jun. 2, 2015

(65) Prior Publication Data

US 2016/0359277 A1 Dec. 8, 2016

(51) Int. Cl.
*H01R 13/648* (2006.01)
*H01R 13/6581* (2011.01)

(52) U.S. Cl.
CPC ..... *H01R 13/6581* (2013.01)

(58) Field of Classification Search
CPC ..... H01R 13/6581
USPC ..... 439/607.01, 701, 607.07, 607.05, 607.1, 439/79
See application file for complete search history.

(56) References Cited

U.S. PATENT DOCUMENTS 6,146,202 A * 11/2000 Ramey ..... H01R 12/585 439/607.1
6,347,962 B1 * 2/2002 Kline ..... H01R 13/514 439/181
6,375,474 B1 * 4/2002 Harper, Jr. ..... H01R 13/2435 439/66
6,386,924 B2 * 5/2002 Long ..... H01R 12/7005 439/607.01
6,409,543 B1 * 6/2002 Astbury, Jr. ..... H01R 13/65807 439/607.07
6,652,319 B1 * 11/2003 Billman ..... H01R 13/514 439/108
6,743,057 B2 * 6/2004 Davis ..... H01R 23/688 439/607.05
7,037,138 B2 * 5/2006 Lang ..... H01R 13/514 439/607.1
7,101,191 B2 * 9/2006 Benham ..... H01R 13/6477 439/65
8,267,721 B2 * 9/2012 Minich ..... H01R 12/724 439/607.05
8,961,229 B2 * 2/2015 Pan ..... H01R 13/6474 439/607.07
9,065,215 B2 * 6/2015 Buck ..... H01R 13/6586
9,225,085 B2 * 12/2015 Cartier, Jr. ..... H01R 12/712
(Continued)

*Primary Examiner* — Abdullah Riyami
*Assistant Examiner* — Nelson R Burgos-Guntin

(57) ABSTRACT

A contact module is provided for an electrical connector. The contact module includes a carrier and a leadframe held by the carrier. The leadframe includes signal contacts that extend outward from the carrier for mating with corresponding mating signal contacts. A ground shield is mounted to the carrier. The ground shield includes a body configured to extend over at least a portion of the leadframe. The ground shield includes ground contacts configured to mate with corresponding mating ground shields. The ground contacts include groups of spring beams. Each group of spring beams includes at least first and second spring beams that extend from the body of the ground shield in respective different directions.

20 Claims, 6 Drawing Sheets

(56) References Cited

U.S. PATENT DOCUMENTS

| | | | | |
|---|---|---|---|---|
| 9,331,407 | B2 * | 5/2016 | Laurx | H01R 12/722 |
| 2005/0287869 | A1 * | 12/2005 | Kenny | H01R 13/6625<br>439/620.12 |
| 2007/0054554 | A1 * | 3/2007 | Do | H01R 23/688<br>439/607.05 |

* cited by examiner

ELECTRICAL CONNECTOR HAVING A GROUND SHIELD

BACKGROUND OF THE INVENTION

The subject matter herein relates generally to electrical connectors having ground shields.

Some electrical systems include a receptacle connector that mates with a header connector to establish an electrical connection between two circuit boards. The receptacle connector may include a housing that holds a plurality of contact modules. Each contact module includes a leadframe having signal contacts that mate with corresponding signal contacts of the header connector. At least some known receptacle connectors include ground shields that are mounted to the contact modules such that the ground shields extend between the leadframes of adjacent contact modules. The ground shields of receptacle connectors may reduce noise and/or crosstalk generated between the leadframes of neighboring contact modules, which for example may be caused by the relatively high transmission frequency of electrical signals through the receptacle and header connectors.

The ground shields of receptacle connectors typically include a body that is mounted to a side of the corresponding contact module such that the body covers at least a portion of the leadframe of the corresponding contact module. Ground contacts (e.g., a resilient beam and/or the like) extend outward from the body of the ground shield for mating with corresponding ground shields of the header connector. But, gaps between adjacent ground contacts of the ground shield may electrically expose one or more of the signal contacts of the corresponding contact module, which may permit noise and/or crosstalk between the exposed signal contact and one or more signal contacts of a neighboring contact module.

Moreover, some known receptacle connector ground shields include ground contacts that only mate with (i.e., physically contact) the corresponding ground shield of the header connector proximate a base (i.e., proximate an end of the mating zone) of the header connector ground shield when the receptacle and header connectors are fully mated together. But, the tip of the ground shield of the header connector may act as an electrical stub that generates electromagnetic interference (EMI) when the ground contacts of a receptacle connector ground shield only mate with the bases of the corresponding header connector ground shields. Such EMI generated by the stubs of the ground shield of the header connector may interfere with the signal integrity of the receptacle and/or header connectors and may thereby decrease the performance thereof.

BRIEF DESCRIPTION OF THE INVENTION

In an embodiment, a contact module is provided for an electrical connector. The contact module includes a carrier and a leadframe held by the carrier. The leadframe includes signal contacts that extend outward from the carrier for mating with corresponding mating signal contacts. A ground shield is mounted to the carrier. The ground shield includes a body configured to extend over at least a portion of the leadframe. The ground shield includes ground contacts configured to mate with corresponding mating ground shields. The ground contacts include groups of spring beams. Each group of spring beams includes at least first and second spring beams that extend from the body of the ground shield in respective different directions.

In an embodiment, an electrical connector includes a housing and contact modules held by the housing. The contact modules include carriers and leadframes held by the carriers. The leadframes include signal contacts that extend outward from the carriers for mating with corresponding mating signal contacts. At least one of the contact modules includes a ground shield mounted to the carrier of the contact module. The ground shield includes a body configured to extend over at least a portion of the leadframe of the contact module. The ground shield includes ground contacts configured to mate with corresponding mating ground shields. The ground contacts include groups of spring beams. Each groups of spring beams includes a first spring beam that extends from the body of the ground shield in a first direction and a second spring beam that extends from the body of the ground shield in a second direction that is different from the first direction.

In an embodiment, a contact module is provided for an electrical connector. The contact module includes a carrier and a leadframe held by the carrier. The leadframe includes signal contacts that extend outward from the carrier for mating with corresponding mating signal contacts. A ground shield is mounted to the carrier. The ground shield includes a body configured to extend over at least a portion of the leadframe. The ground shield includes ground contacts configured to mate with corresponding mating ground shields. The body of the ground shield includes a gap segment that extends within a gap between adjacent ground contacts. The gap segment at least partially closes the gap between the adjacent ground contacts such that the gap segment extends over at least a portion of at least one signal contact that is at least partially aligned with the gap.

DETAILED DESCRIPTION OF THE INVENTION

Figure 1:
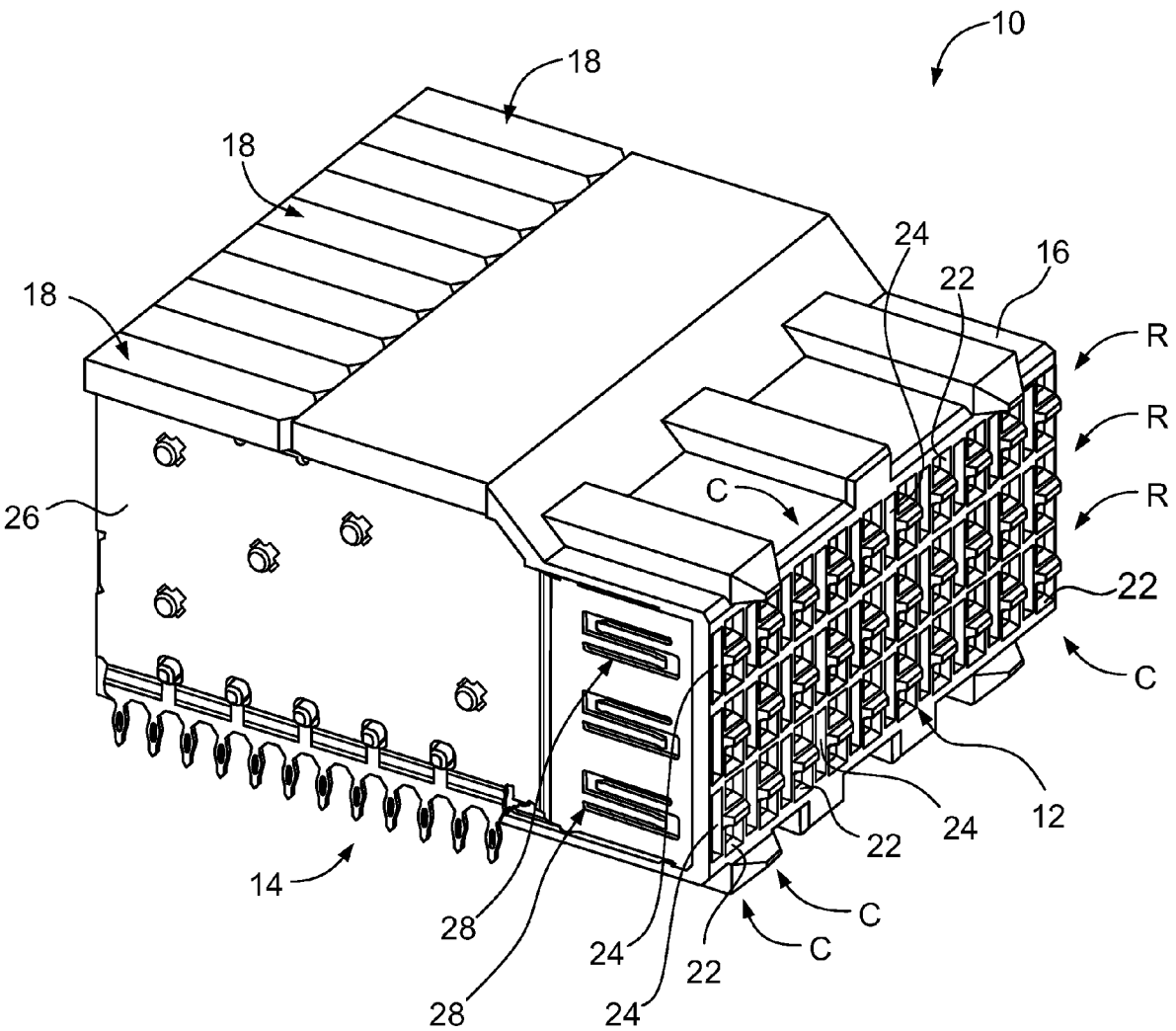
FIG. 1 is a perspective view of an embodiment of a receptacle connector.

FIG. 1 is a perspective view of an embodiment of a receptacle connector 10. The receptacle connector 10 is configured to mate with a header connector (not shown) to establish an electrical connection between two circuit boards (not shown). In some embodiments, the receptacle connector 10 is configured to mate directly with a circuit board. In the illustrated embodiment, the receptacle connector 10 includes a mating interface 12 configured to be mated with the header connector. Although shown and described herein as a "receptacle" connector 10, in other embodiments the connector 10 is another type of electrical connector, such as, but not limited to, a header connector.

The receptacle connector 10 is configured to be mounted to one of the circuit boards along a mounting interface 14 of the receptacle connector 10. In the illustrated embodiment, the mounting interface 14 is orientated perpendicular to the mating interface 12. When the receptacle connector 10 is coupled to the header connector, the circuit boards are orientated approximately perpendicular to each other; however, other orientations are possible in other embodiments.

The receptacle connector 10 includes a housing 16 that holds a plurality of contact modules 18. The contact modules 18 are held in a stacked configuration generally parallel to one another. The contact modules 18 hold a plurality of signal contacts 20 (shown in FIGS. 2 and 5) that extend along the mating interface 12 for mating with corresponding mating signal contacts (not shown) of the header connector. Optionally, the signal contacts 20 are arranged in pairs carrying differential signals, as is shown in the illustrated embodiment. In the illustrated embodiment, the contact modules 18 are oriented generally along vertical planes. But, other orientations are possible in other embodiments. For example, in some embodiments, the contact modules 18 are oriented generally along horizontal planes.

The housing 16 is manufactured from a dielectric material, such as, but not limited to, a plastic material. The housing 16 includes a plurality of signal contact openings 22 and a plurality of ground contacts openings 24 extending along the mating interface 12. The contact modules 18 are mounted to the housing 16 such that the signal contacts 20 are received in corresponding signal contact openings 22. Optionally, a single signal contact 20 is received in each signal contact opening 22. The signal contact openings 22 also receive corresponding mating signal contacts of the header connector therein when the receptacle connector 10 is mated with the header connector.

The signal contact openings 22, and thus the signal contacts 20, may be arranged in any pattern. In the illustrated embodiment, the signal contact openings 22 are arranged in an array of rows R and columns C. The columns C are oriented generally vertically and the rows R are oriented generally horizontally; however, other orientations are possible in other embodiments. In the illustrated embodiment, the signal contacts 20 within each differential pair are arranged in a same column C, and thus the receptacle connector 10 defines a pair-in-column receptacle connector. In other embodiments, the signal contacts 20 within each differential pair are arranged in the same row R such that the receptacle connector 10 defines a pair-in-row receptacle connector.

The contact modules 18 include ground shields 26 that provide electrical shielding for the signal contacts 20 from electromagnetic interference (EMI) and/or radio frequency interference (RFI). As will be described in more detail below, the ground shields 26 include ground contacts 28 that are configured to mate with corresponding mating ground shields 30 (shown in FIG. 6) of the header connector. The contact modules 18 are mounted to the housing 16 such that the ground contacts 28 are received in corresponding ground contact openings 24. Optionally, a single ground contact 28 is received in each ground contact opening 28. The ground contact openings 24 also receive the corresponding mating ground shields 30 of the header connector therein when the receptacle connector 10 is mated with the header connector.

Figure 2:
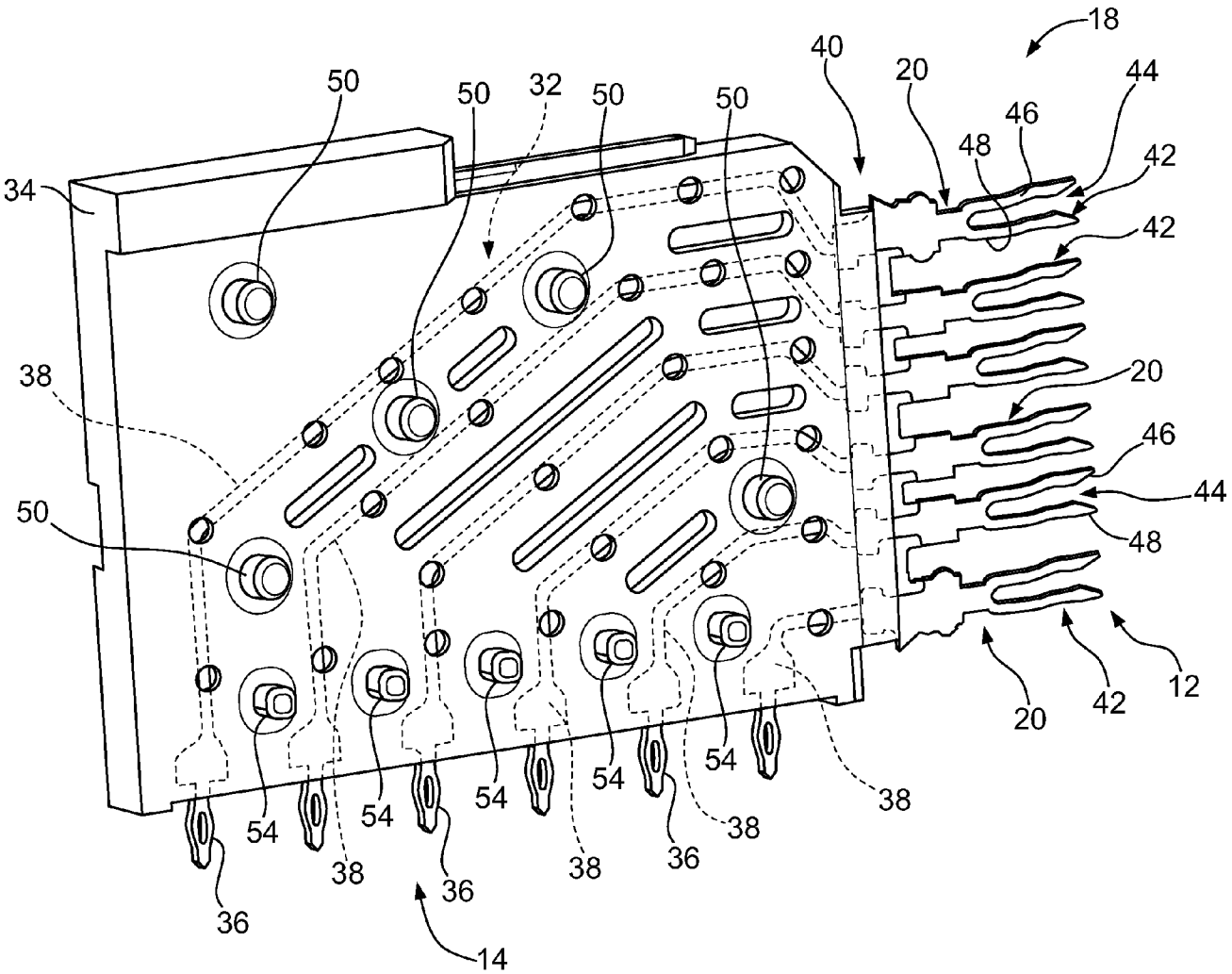
FIG. 2 is a perspective view of a portion of an embodiment of a contact module of the receptacle connector shown in FIG. 1.

FIG. 2 is a perspective view of a portion of an embodiment of a contact module 18. The ground shield 26 (shown in FIGS. 1 and 3-6) of the contact module 18 has been removed (i.e., is not shown in FIG. 2) to better illustrate the remainder of the contact module 18. The contact module 18 includes a leadframe 32 and a dielectric carrier 34 that holds the leadframe 32. The carrier 34 may be overmolded over the leadframe 32, though additionally or alternatively other manufacturing processes may be utilized to form the carrier 34. Optionally, the leadframe 32 is stamped and formed. In addition or alternatively, other manufacturing processes are used to form the leadframe 32.

The leadframe 32 includes the signal contacts 20, a plurality of mounting contacts 36, and leads 38 that connect the signal contacts 20 to the corresponding mounting contacts 36. The signal contacts 20, the leads 38, and the mounting contacts 36 define signal paths through the contact module 18. As shown in FIG. 2, the signal contacts 20 extend outward from a front end 40 of the carrier 34 such that the signal contacts 20 define a portion of the mating interface 12 of the receptacle connector 10 (shown in FIG. 1). The signal contacts 20 include mating segments 42 that are configured to be mated with, and electrically connected to, corresponding mating signal contacts of the header connector. The mating segments 42 define receptacle type mating ends having a receptacle 44 that is configured to receive a pin type contact of the header connector. In the illustrated embodiment, each mating segment 42 is a split beam type of contact having opposed beams 46 and 48 that define and flank the receptacle 44. Other types, structures, and/or the like of mating segments 42 may be provided in other embodiments. The contact module 18 may include any number of the signal contacts 20 and any number of differential pairs of the signal contacts 20.

As described above, the signal contacts 20 are optionally arranged as differential pairs. Optionally, both of the signal contacts 20 of each pair are held by the same contact module 18 (i.e., are from the same leadframe 32), as is shown in the illustrated embodiment. The contact module 18 may include any number of the signal contacts 20 and any number of differential pairs of the signal contacts 20.

The mounting contacts 36 are configured to be mounted to the corresponding circuit board in electrical contact therewith to electrically connect the signal contacts 20 to the circuit board. When the contact module 18 is mounted to the housing 16 (shown in FIG. 1) of the receptacle connector 10, the mounting contacts 36 extend along (and define a portion of) the mounting interface 14 of the receptacle connector 10 for mounting the receptacle connector 10 to the circuit board. In the illustrated embodiment, the mounting contacts 36 are compliant eye-of-the needle (EON) pins, but any other type, structure, and/or the like of contact may additionally or alternatively be used to mount the receptacle connector 10 to the circuit board, such as, but not limited to, a different type of compliant pin, a solder tail, a surface mount structure, and/or the like. The contact module 18 may include any number of the mounting contacts 36.

The carrier 34 of the contact module 18 optionally includes one or more retention features 50 that facilitate mounting the ground shield 26 (FIG. 1) of the contact module 18 to the carrier 34. In the illustrated embodiment, the retention features 50 are posts that are configured to be received within corresponding retention openings 52 (shown in FIGS. 3 and 5) of the ground shield 26 with an interference fit. But, any other type, structure, and/or the like of retention feature may be additionally or alternatively used to mount the ground shield 26 to the carrier 34.

Optionally, the carrier 34 of the contact module 18 includes one or more support features 54 that facilitate supporting mounting contacts 56 (shown in FIG. 3) of the ground shield 26 of the contact module 18. The illustrated embodiment of the support features 54 are posts that are configured to be received within corresponding support openings 58 (shown in FIGS. 3 and 5) of the ground shield 26. But, any other type, structure, and/or the like of support feature may be additionally or alternatively used to support the mounting contacts 56.

Figure 3:
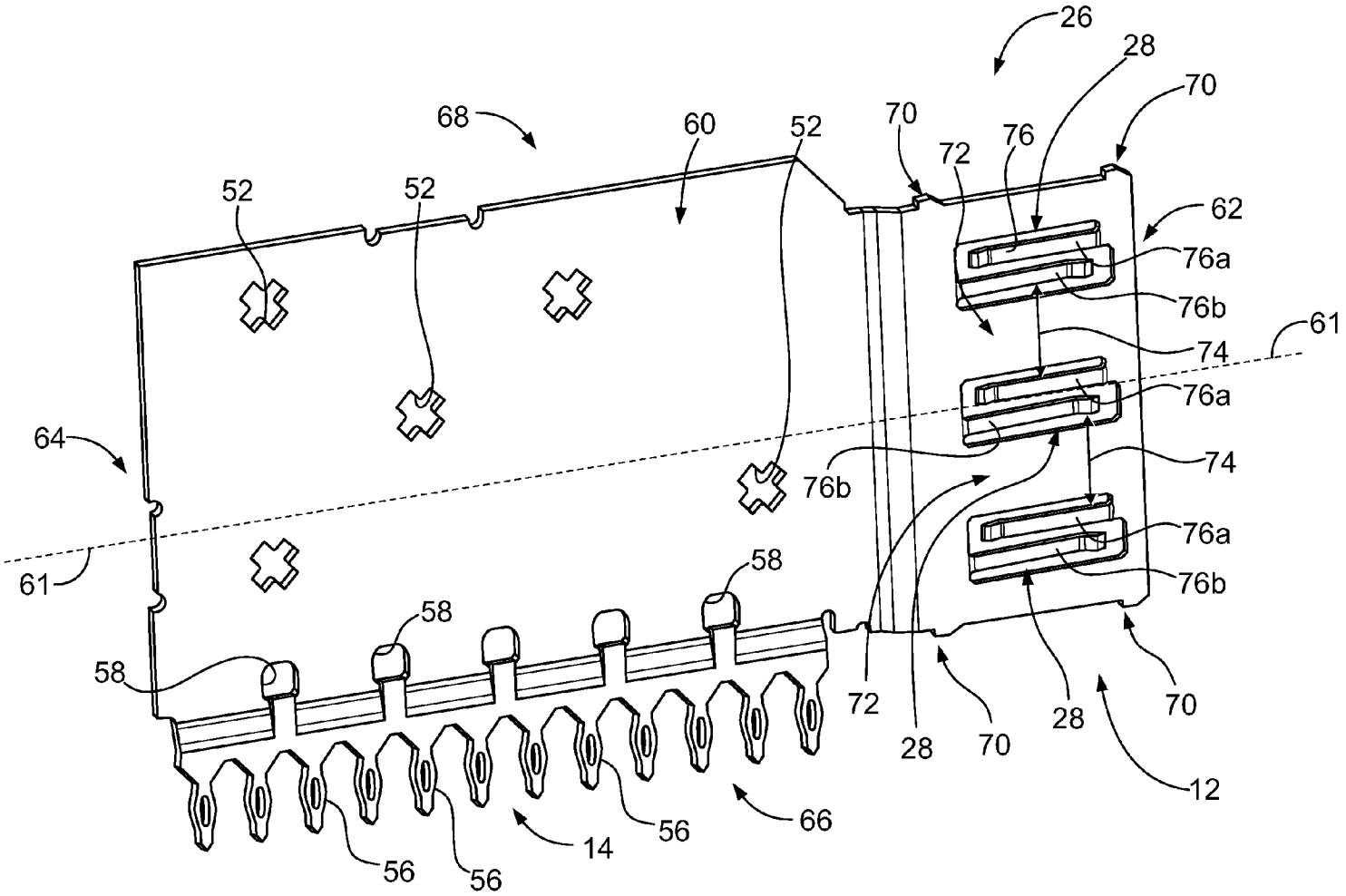
FIG. 3 is a perspective view of an embodiment of a ground shield of the contact module shown in FIG. 2.

FIG. 3 is a perspective view of an embodiment of a ground shield 26. The ground shield 26 includes a body 60 that extends a length along a mating axis 61 from a front end 62 to a rear end 64. The body 60 also extends from a mounting end 66 to an opposite end 68. The ground shield includes the mounting contacts 56, which extend along the mounting end 66 and are configured to be mounted to the corresponding circuit board in electrical contact therewith to electrically connect the ground shield 26 to a ground plane (not shown) of the circuit board. When the contact module 18 (shown in FIGS. 1, 2, and 5) that includes the ground shield 26 is mounted to the housing 16 (shown in FIG. 1) of the receptacle connector 10 (shown in FIG. 1), the mounting contacts 56 extend along (and define a portion of) the mounting interface 14 of the receptacle connector 10 for mounting the receptacle connector 10 to the circuit board.

The illustrated embodiment of the mounting contacts 56 are compliant eye-of-the needle (EON) pins. But, additionally or alternatively any other type, structure, and/or the like of contact may be used to mount the receptacle connector 10 to the circuit board, such as, but not limited to, a different type of compliant pin, a solder tail, a surface mount structure, and/or the like. The ground shield 26 may include any number of the mounting contacts 56. The number of the mounting contacts 56 may be selected to increase the ground path between the receptacle connector 10 and the circuit board to which the receptacle connector 10 is mounted. In some embodiments, the ground shield 26 may have more mounting contacts 56 than to at least some known ground shields of contact modules.

Figure 5:
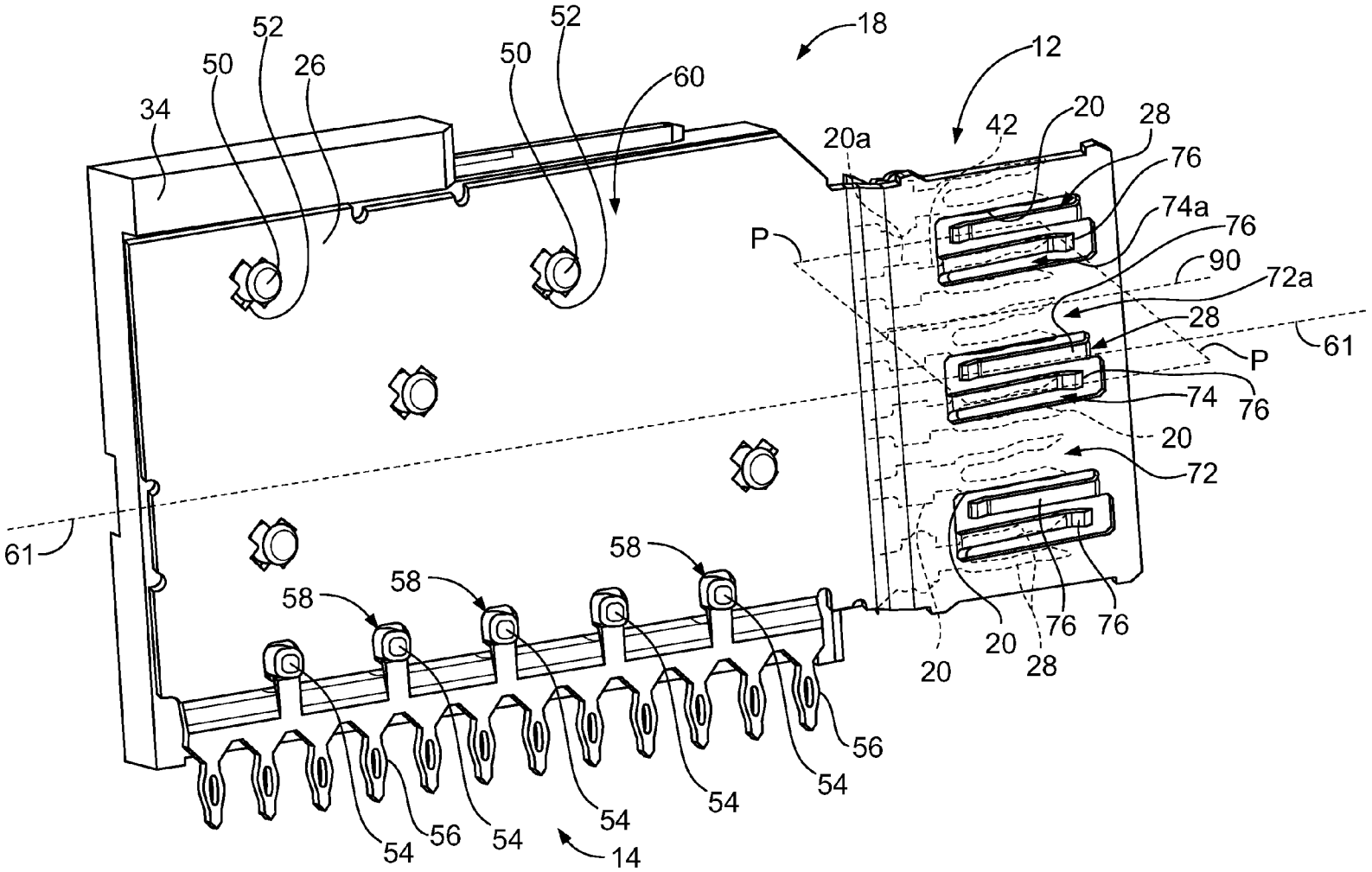
FIG. 5 is a perspective view of the contact module shown in FIG. 2 illustrating the ground shield shown in FIGS. 3 and 4 mounted thereto.

The body 60 of the ground shield 26 is electrically conductive and is configured to electrical shield the signal contacts 20 from electromagnetic interference (EMI) and/or radio frequency interference (RFI). Specifically, the body 60 extends over at least a portion of the corresponding leadframe 32 (shown in FIG. 2) when the body 60 is mounted to the corresponding carrier 34. In the illustrated embodiment, the body 60 is configured to extend over the leads 38 (shown in FIG. 2), portions of the signal contacts 20 (shown in FIGS. 2 and 5), and portions of the mounting contacts 36 (shown in FIG. 2), as is shown in FIG. 5. The body 60 of the ground shield 26 is thus configured to provide electrical shielding for the leadframe 32 along substantially the entire length of the leadframe 32 between the mounting interface 14 (shown in FIG. 1) and the mating interface 12 of the receptacle connector 10.

The body 60 of the ground shield 26 optionally includes one or more retention features 70 that facilitate mounting the corresponding contact module 18 to the housing 16 (shown in FIG. 1) of the receptacle connector 10. In the illustrated embodiment, the retention features 70 are barbs that are configured to engage the body 60 with the housing 16 with an interference fit. But, any other type, structure, and/or the like of retention feature may additionally or alternatively be used to mount the contact modules 18 to the housing 16. The body 60 of the ground shield 26 includes the retention openings 52 that facilitate mounting the ground shield 26 to the corresponding carrier 34 (shown in FIGS. 2 and 5). The body 60 of the ground shield 26 also includes the support openings 58 that facilitate supporting the mounting contacts 56 of the ground shield 26.

As will be described in more detail below, the ground shield 26 includes the ground contacts 28 that are configured to mate with the corresponding mating ground shields 30 (shown in FIG. 6) of the header connector. The ground contacts 28 define a portion of the mating interface 12 of the receptacle connector 10. The body 60 of the ground shield 26 includes gap segments 72 that extend within corresponding gaps 74 between adjacent ground contacts 28. Specifically, the gap segments 72 of the body 60 extend within corresponding gaps 74 between spring beams 76 of adjacent ground contacts 28. As shown in FIG. 3, the gap segments 72 of the body 60 partially close the corresponding gaps 74 between adjacent ground contacts 28, which as will be described below increases the amount of ground shielding and ground coverage of the signal contacts 20.

As briefly mention above, the ground contacts 28 include spring beams 76. Specifically, each ground contact 28 includes a group of spring beams 76 that includes at least two spring beams 76. In the illustrated embodiment, each ground contact 28 includes a pair of spring beams 76, namely a spring beam **76*a* and a spring beam 76*b*. But, the group of spring beams 76 of each ground contact 28 may include any other number of spring beams 76 greater than one. Each of the spring beams 76*a* and 76*b*** may be referred to herein as a "first" and/or a "second" spring beam.

Figure 4:
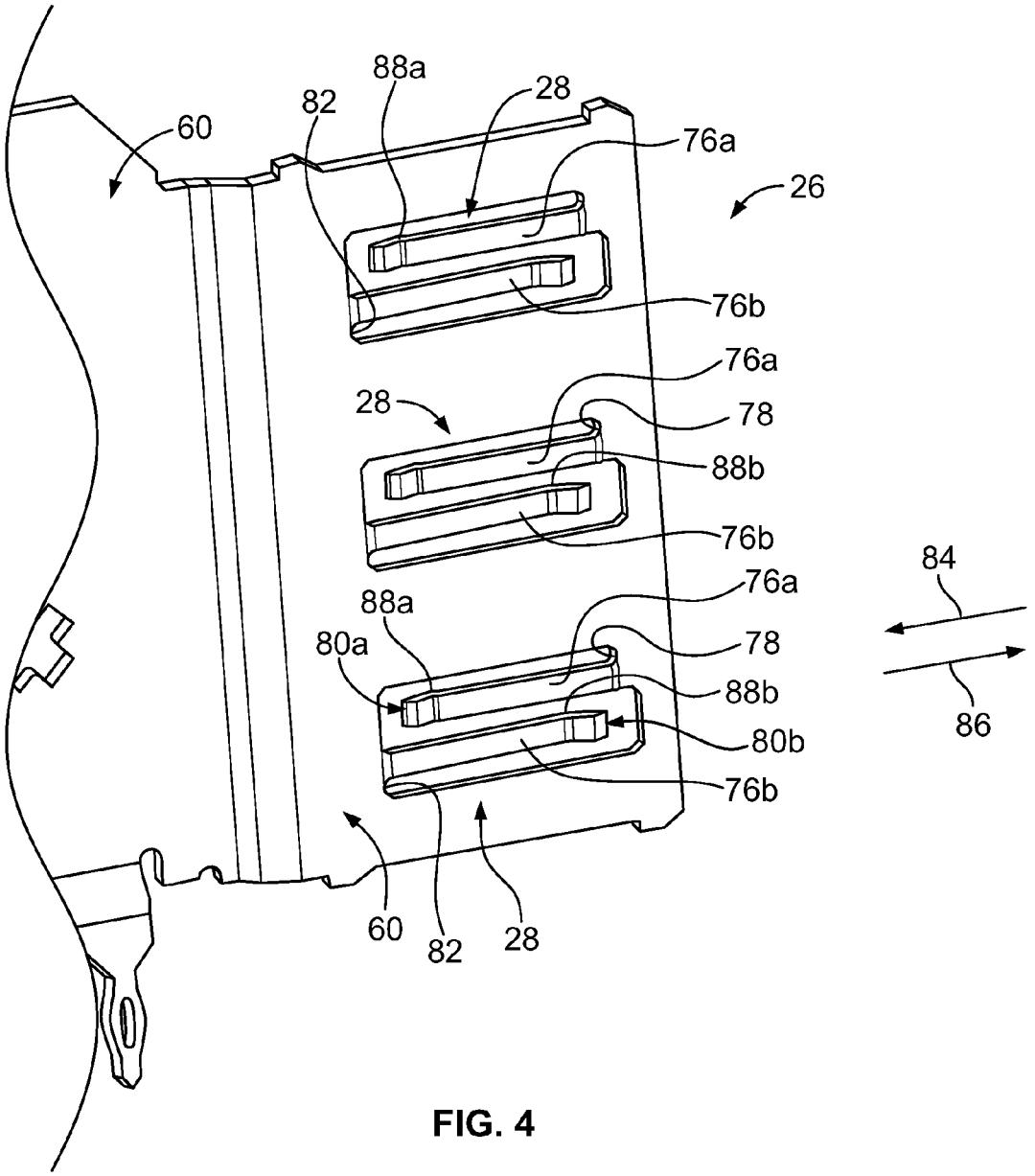
FIG. 4 is an enlarged perspective view of the ground shield shown in FIG. 3.

FIG. 4 is an enlarged perspective view of the ground shield 26 illustrating the ground contacts 28. The spring beams 76 extend longitudinally from edges of the body 60 of the ground shield 26. Specifically, the spring beam **76*a* extends longitudinally from an edge 78 of the body 60 to a tip 80*a* of the spring beam 76*a*; and the spring beam 76*b* extends longitudinally from an edge 82 of the body 60 to a tip 80*b* of the spring beam 76*b*. Each of the edges 78 and 82** may be referred to herein as a "first" and/or a "second" edge.

As shown herein, the spring beams **76*a* and 76*b* extend from the body 60 of the ground shield 26 in respective different directions. Specifically, the spring beam 76*a* extends from the edge 78 of the body 60 in a direction 84, and the spring beam 76*b* extends from the edge 82 of the body 60 in a direction 86. As can be seen in FIG. 4, the directions 84 and 86 are different from each other. Each of the directions 84 and 86** may be referred to herein as a "first" and/or a "second" direction.

In the illustrated embodiment, the directions 84 and 86 are opposite such that the spring beams **76*a* and 76*b* extend from the edges 78 and 82 of the body 60 in respective opposite directions. Moreover, in the illustrated embodiment, the spring beams 76*a* and 76*b* are arranged side-by-side; the directions 84 and 86 are approximately parallel such that the spring beams 76*a* and 76*b* are approximately parallel; and the directions 84 and 86 may be considered to oppose each other because the edges 78 and 82 oppose (i.e., face) each other. But, any other relative orientation, relative arrangement, and/or the like between the spring beams 76*a* and 76*b* of each ground contact 28 may be used in other embodiments. For example, in some other embodiments, the spring beams 76*a* and 76*b* of a ground contact 28 are not parallel. Moreover, and for example, in some other embodiments the edges 78 and 82 may face away from each other (e.g., in opposite directions) such that the spring beams 76*a* and 76*b*** extend away from each other.

The spring beams **76*a* and 76*b* include respective mating interfaces 88*a* and 88*b*. The spring beams 76*a* and 76*b* are configured to mate (i.e., engage in physical contact) with the corresponding mating ground shield 30 (shown in FIG. 6) of the header connector at the respective mating interfaces 88*a* and 88*b* to establish an electrical connection between the spring beams 76***a* and 76*b* and the corresponding mating ground shield 30. As shown herein, the mating interfaces 88*a* and 88*b* are offset from each other along the length of the body 60 of the ground shield 26 (i.e., the mating interfaces 88*a* and 88*b* are offset from each other along the mating axis 61). Accordingly, and as will be described below and shown in FIG. 6, the spring beams 76*a* and 76*b* are configured to mate with the corresponding mating ground shield 30 at different locations along the length of the corresponding mating ground shield 30. The mating interfaces 88*a* and 88*b* may be offset from each other by any amount. Each of the mating interfaces 88*a* and 88*b* may be referred to herein as a "first" and/or a "second" mating interface.

FIG. 5 is a perspective view of one of the contact modules 18 illustrating the ground shield 26 mounted to the carrier 34 thereof. The retention features 50 of the carrier 34 are received within the corresponding retention openings 52 of the ground shield 26 to hold the body 60 of the ground shield 26 to the carrier 34. Moreover, the support features 54 of the carrier 34 are received within the corresponding support openings 58 of the ground shield 26 to support the mounting contacts 56 of the ground shield 26.

In the illustrated embodiment, the body 60 of the ground shield 26 extends over the leadframe 32 (shown in FIG. 2) along substantially the entire length of the leadframe 32 between the mounting interface 14 and the mating interface 12 of the receptacle connector 10 (shown in FIG. 1). Accordingly, the illustrated embodiment of the body 60 of the ground shield 26 provides electrical shielding for the leadframe 32 along substantially the entire length of the leadframe 32 between the mounting interface 14 and the mating interface 12 of the receptacle connector 10.

As shown in FIG. 5, the mating segments 42 of some of the signal contacts 20 are aligned with corresponding ones of the gaps 74 between the spring beams 76 of adjacent ground contacts 28. For example, the mating segment 42 of a signal contact 20*a* extends a length along an axis 90 that lies within a plane P that extends approximately perpendicular to a corresponding gap 74*a*. The plane P intersects the gap 74*a*, as is shown in FIG. 5. Accordingly, the mating segment 42 of the signal contact 20*a* is at least partially aligned with the gap 74*a*. If the gap segments 72 were not provided, the signal contacts 20 that are at least partially aligned with a gap 74 (e.g., the signal contact 20*a*) would be electrically exposed. But, as shown in FIG. 5, the gap segments 72 of the body 60 partially close the corresponding gaps 74 and thereby extend over at least a portion of the signal contacts 20 that are at least partially aligned with the corresponding gap 74. For example, a gap segment 72*a* is shown in FIG. 5 as extending over the mating segment 42 of the signal contact 20*a* (e.g., the gap segment 72*a* is shown in FIG. 5 as being intersected by the plane P). By partially closing the gaps 74 and thereby covering at least a portion of any signal contacts 20 that are aligned with the gaps 74, the gap segments 72 increase the ground shielding of the signal contacts 20, which may facilitate reducing signal noise and/or crosstalk.

Figure 6:
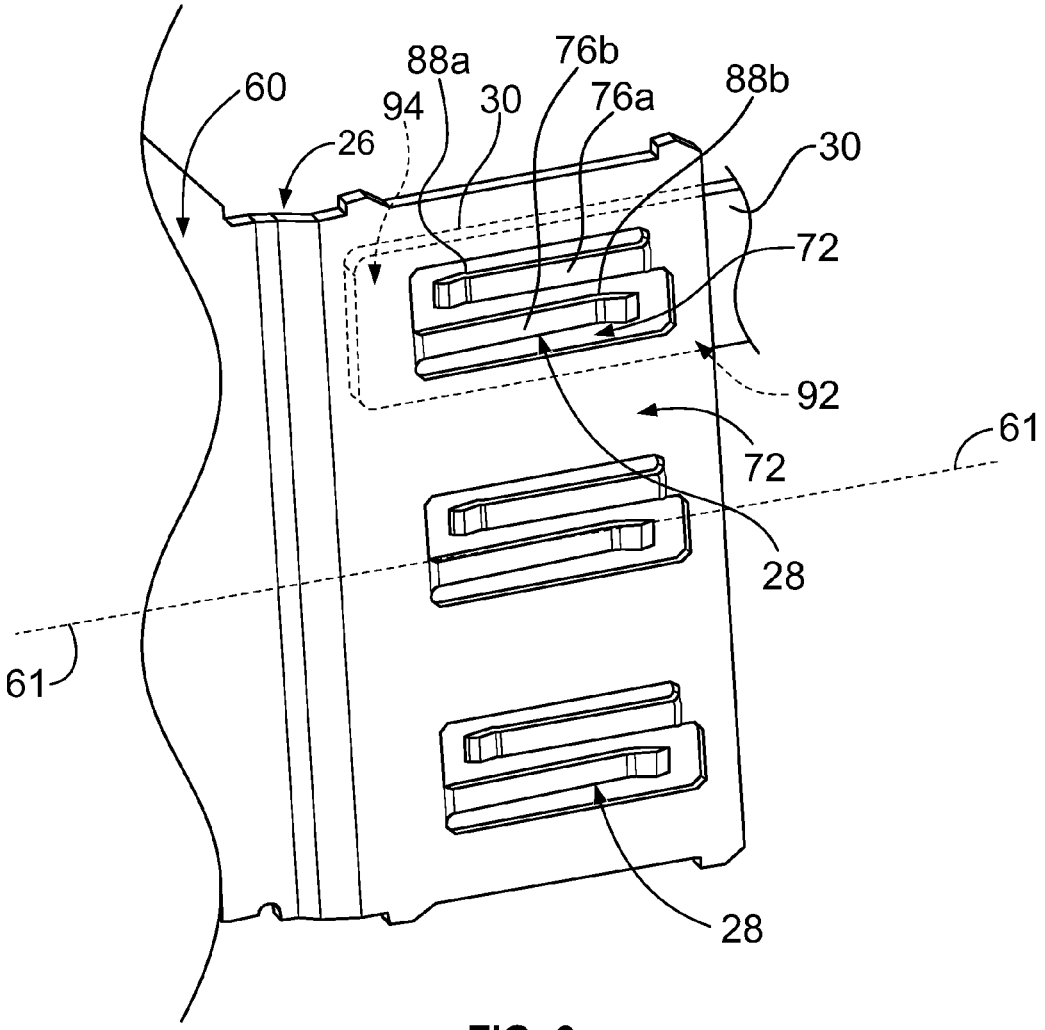
FIG. 6 is a perspective view of the ground shield shown in FIGS. 3-5 illustrating an embodiment of a ground contact of the ground shield as mated with an exemplary corresponding mating ground shield.

FIG. 6 is a perspective view of a ground shield 26 illustrating a ground contact 28 of the ground shield 26 as mated with the corresponding mating ground shield 30 of the header connector. As can be seen in FIG. 6, the mating ground shield 30 extends a length from a base 92 to a tip 94. The mating ground shield 30 is mated with the corresponding ground contact 28. Specifically, the spring beams 76*a* and 76*b* of the ground contact 28 are engaged in physical contact with the mating ground shield 30 at the respective mating interfaces 88*a* and 88*b* such that the ground contact 28 and the mating ground shield 30 are electrically connected together.

As described above, the mating interfaces 88*a* and 88*b* of the ground contact 28 are offset from each other along the length of the body 60 of the ground shield 26 (i.e., along the mating axis 61) such that the spring beams 76*a* and 76*b* are mated with the mating ground shield 30 at different locations along the length of the mating ground shield 30. In the illustrated embodiment, the spring beam 76*b* is mated with the mating ground shield 30 proximate the base 92 of the mating ground shield 30; and the spring beam 76*a* is mated with the mating ground shield 30 proximate the tip 94 of the mating ground shield 30. The offset mating locations of the spring beams 76*a* and 76*b* may reduce the size of, or eliminate, an electrical stub formed by the tip 94 of the mating ground shield 30.

The spring beams 76*a* and 76*b* may provide an increased amount of ground shielding and/or ground coverage of the leadframe 32 (shown in FIG. 2). For example, the spring beams 76*a* and 76*b* may provide an increased ground path (e.g. the dual spring beams 76*a* and 76*b* of each ground contact 28 provides dual electrical paths). Moreover, and for example, the ground shielding and ground coverage is increased by the mating ground shields 30 closing the remainder of the gaps 74 between adjacent ground contacts 28.

The spring beams 76*a* and 76*b* may provide a more balanced interface between the ground contacts 28 and the corresponding mating ground shields 30, for example as compared to at least some known ground shields. For example, the offset mating locations of the spring beams 76*a* and 76*b* may provide a more even distribution of ground between the ground contacts 28 and the corresponding mating ground shields 30. Moreover, and for example, the different longitudinal directions of the spring beams 76*a* and 76*b* may provide a more even distribution of ground between the ground contacts 28 and the corresponding mating ground shields 30.

The embodiments described and/or illustrated herein may provide a receptacle connector having improved signal integrity and thereby improved performance (e.g., the receptacle connector may be capable of carrying higher signal transmission frequencies), for example as compared to at least some known receptacle connectors. For example, the embodiments described and/or illustrated herein may reduce crosstalk and/or signal noise, may eliminate or reduce electrical stubs, may provide an increased amount of ground shielding and/or ground coverage, and/or may provide an increased ground path. The embodiments described and/or illustrated herein may be backwards compatible with header connectors that carry lower signal transmission frequencies as compared to the embodiments described and/or illustrated herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A contact module for an electrical connector, the contact module comprising:

a carrier;

a leadframe held by the carrier, the leadframe comprising signal contacts that extend outward from the carrier for mating with corresponding mating signal contacts; and a ground shield mounted to the carrier, the ground shield comprising a body configured to extend over at least a portion of the leadframe, the ground shield comprising ground contacts configured to mate with corresponding mating ground shields, the ground contacts comprising groups of spring beams, wherein each group of spring beams includes at least first and second spring beams that extend from the body of the ground shield in respective different directions, the first and second spring beams being vertically staggered such that the first spring beam is vertically offset from the second spring beam.

2. The contact module of claim 1, wherein the respective different directions are respective opposite directions.

3. The contact module of claim 1, wherein the respective different directions are approximately parallel to each other.

4. The contact module of claim 1, wherein the first and second spring beams extend from respective edges of the body, and the respective edges oppose each other.

5. The contact module of claim 1, wherein the first and second spring beams are arranged side-by-side.

6. The contact module of claim 1, wherein the first spring beam extends from a first edge of the body of the ground shield, the second spring beam extending from a second edge of the body that faces the first edge.

7. The contact module of claim 1, wherein the body of the ground shield extends a length along a mating axis, the first and second spring beams comprising respective first and second mating interfaces at which the first and second spring beams, respectively, mate with the corresponding mating ground shield, the first and second mating interfaces being offset from each other along the mating axis of the body of the ground shield such that the first and second spring beams are configured to mate with the corresponding mating ground shield at different locations along a length of the corresponding mating ground shield.

8. The contact module of claim 1, wherein the first spring beam is configured to mate with the corresponding mating ground shield proximate a base of the corresponding mating ground shield, and the second spring beam is configured to mate with the corresponding mating ground shield proximate a tip of the corresponding mating ground shield.

9. The contact module of claim 1, wherein the body of the ground shield comprises a gap segment that extends within a gap between the groups of spring beams of adjacent ground contacts, the gap segment at least partially closing the gap such that the gap segment extends over at least a portion of at least one signal contact that is at least partially aligned with the gap.

10. An electrical connector comprising:

a housing; and contact modules held by the housing, the contact modules comprising carriers and leadframes held by the carriers, the leadframes comprising signal contacts that extend outward from the carriers for mating with corresponding mating signal contacts, at least one of the contact modules comprising a ground shield mounted to the carrier of the contact module, the ground shield comprising a body configured to extend over at least a portion of the leadframe of the contact module, the body extends between a top end and a bottom end along a vertical axis, the ground shield comprising ground contacts configured to mate with corresponding mating ground shields, the ground contacts comprising groups of spring beams, wherein each group of spring beams includes a first spring beam that extends from the body of the ground shield in a first direction and a second spring beam that extends from the body of the ground shield in a second direction that is different from the first direction, the first and second spring beams being vertically staggered such that the first spring beam is vertically offset from the second spring beam along the vertical axis.

11. The electrical connector of claim 10, wherein the first and second directions are respective opposite directions.

12. The electrical connector of claim 10, wherein the first and second directions are approximately parallel.

13. The electrical connector of claim 10, wherein the first and second spring beams extend from respective edges of the body, and the respective edges oppose each other.

14. The electrical connector of claim 10, wherein the first and second spring beams are arranged side-by-side.

15. The electrical connector of claim 10, wherein the first spring beam extends outward from a first edge of the body of the ground shield, the second spring beam extending outward from a second edge of the body that faces the first edge.

16. The electrical connector of claim 10, wherein the body of the ground shield extends a length along a mating axis, the first and second spring beams comprising respective first and second mating interfaces at which the first and second spring beams, respectively, mate with the corresponding mating ground shield, the first and second mating interfaces being offset from each other along the mating axis of the body of the ground shield such that the first and second spring beams are configured to mate with the corresponding mating ground shield at different locations along a length of the corresponding mating ground shield.

17. The electrical connector of claim 10, wherein the first spring beam is configured to mate with the corresponding mating ground shield proximate a base of the corresponding mating ground shield, the second spring beam being configured to mate with the corresponding mating ground shield proximate a tip of the corresponding mating ground shield.

18. A contact module for an electrical connector, the contact module comprising:

a carrier;

a leadframe held by the carrier, the leadframe comprising signal contacts that extend outward from the carrier for mating with corresponding mating signal contacts along a mating axis; and a ground shield mounted to the carrier, the ground shield comprising a body configured to extend over at least a portion of the leadframe, the body extends between a top end and a bottom end along a vertical axis generally perpendicular to the mating axis, the ground shield comprising vertically staggered ground contacts along the vertical axis configured to mate with corresponding mating ground shields, the body of the ground shield comprising a gap segment that extends within a gap between adjacent ground contacts along the vertical axis, wherein the gap segment at least partially closes the gap between the adjacent ground contacts such that the gap segment extends over at least a portion of at least one signal contact that is at least partially aligned with the gap.

19. The contact module of claim 1, wherein the at least one signal contact that is at least partially aligned with the gap between adjacent ground contacts extends a length along an axis that lies within a plane that extends approximately perpendicular to the gap, the gap segment extending over the at least one signal contact such that the gap segment is intersected by the plane.

20. The contact module of claim 1, wherein the at least one signal contact that is at least partially aligned with the gap between adjacent ground contacts extends a length along an axis that lies within a plane that extends approximately perpendicular to the gap and intersects the gap.

* * * * *